US006283027B1

(12) United States Patent
Vrotacoe et al.

(10) Patent No.: US 6,283,027 B1
(45) **Date of Patent: *Sep. 4, 2001**

(54) VARYING PROFILE CYLINDER BLANKET

(75) Inventors: James B. Vrotacoe, Rochester; Charles Reif Hammond, Dover, both of NH (US); Daniel Paul Gagne, South Berwick, ME (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/593,022

(22) Filed: Jun. 13, 2000

Related U.S. Application Data

(63) Continuation of application No. 08/857,078, filed on May 15, 1997, now Pat. No. 6,105,498, which is a continuation of application No. 08/554,795, filed on Nov. 7, 1995, now abandoned, which is a continuation of application No. 08/170,956, filed on Dec. 21, 1993, now abandoned.

(51) Int. Cl.[7] ..... B41F 13/10
(52) U.S. Cl. ..... 101/376; 428/909
(58) Field of Search ..... 101/177, 181, 101/183, 216, 217, 228, 232, 375, 376, 401.1, DIG. 42; 492/28, 29, 30, 50, 51, 48, 49, 55, 56; 428/909

(56) References Cited

U.S. PATENT DOCUMENTS

| | | | | |
|---|---|---|---|---|
| 1,999,733 | * | 4/1935 | Luehrs | 154/54.5 |
| 5,215,013 | * | 6/1993 | Vrotacoe et al. | 101/217 |
| 5,285,726 | * | 2/1994 | Ohta | 101/228 |
| 5,350,623 | * | 9/1994 | Derrick | 101/375 |
| 5,522,315 | | 6/1996 | Behnke et al. . | |
| 5,863,367 | | 1/1999 | Behnke et al. . | |

FOREIGN PATENT DOCUMENTS 60-112566 * 6/1985 (JP) .

* cited by examiner

*Primary Examiner*—Ren Yan
(74) *Attorney, Agent, or Firm*—Kenyon & Kenyon

(57) ABSTRACT

A blanket that has a varying profile and a method for its use is disclosed. By varying the profile of the blanket cylinder and/or blanket, either in terms of its material properties or its thickness, the blanket, when placed about a blanket cylinder, corrects for unwanted variation in the velocity profile present in the web. Such velocity profile variations, if not taken into account, may cause wrinkling of a web passing over the blanket cylinder in a printing press and thus cause misregistered images. In a further embodiment, the blanket cylinder may be provided with a varying profile.

10 Claims, 6 Drawing Sheets

VARYING PROFILE CYLINDER BLANKET

This application is a continuation of prior application Ser. No. 08/857,078, filed May 15, 1997, now U.S. Pat. No. 6,105,498, which is a continuation of Ser. No. 08/554,795, filed Nov. 7, 1995, now abandoned, which is a continuation of Ser. No. 08/170,956, filed Dec. 21, 1993, also abandoned.

BACKGROUND OF THE INVENTION

The present invention relates to problems extant in printing, particularly with respect to offset printing.

During operation of an offset printing press, an ink pattern is applied to sheet material at a printing station by a blanket that is mounted to a blanket cylinder. The pattern is applied to the blanket by a plate cylinder. For full color printing, lithographic printing typically makes use of four such blankets and cylinders at four printing stations: one for each process color, and one for providing black. Full color images are formed by superimposing the four patterns onto one another. In order for the four images laid down by the four separate blankets to properly form an image, the images formed at each printing station by each blanket must be in registration with respect to each other.

Virtually anything that distorts the geometry of the web (typically paper) on which the image is formed in ways that are not anticipated and corrected for will cause the registration of images to be inexact. The less exact the registration of images, the greater the composite image will be seen to blur.

One source of distortion arises from the tendency of the web to absorb moisture as it traverses the printing stations. The source of this moisture is in the fountain solution that is applied to the plate that is used to mask off those portions of the plate on which one does not want ink (which is hydrophobic) to appear. The web may absorb this moisture in sufficient quantities for the web to experience "fan-out," which is a form of lateral expansion. As this can occur in each printing station and can progressively worsen from station to station, the lateral geometry of the web may become increasingly widened and distorted as the web passes through the press. This lateral distortion results in the misregistration of images alluded to above.

A common solution to this problem is to create a compensatory distortion in the web before it arrives at the blanket portion of the printing station. So-called "bustle wheels" have been used for this purpose. The bustle wheel is a rotating disk that presses a width-contracting furrow into the web prior to the printing station. Hence, after the web has expanded due to moisture absorption, its expansion is compensated for by the contraction imposed by the bustle wheel, and registration is enhanced. The bustle wheel can be viewed as a solution to a very specific type of distortion that arises downstream in the printing units.

Another common source of web distortion is the tendency of the web to wrinkle as it is used in lithographic printing. Therefore, significant attention has been paid to this type of distortion. The sources of wrinkling are varied, and include vibrations and mechanical misalignments, as well as inconsistencies in the production of the web itself. One solution to the problem of wrinkles is attempting to eliminate them after they have formed. For example, a concave spreader roller is often employed to laterally spread the wrinkled web, thereby ridding the web of wrinkles that have already formed. The web is general wrapped about a 90–180 degree arc of a rigid steel roller that is concave in profile. The movement of the web in cooperation with so great an extent of the concave metal roll causes the web to be laterally stretched. A variant of the concave spreader roller is a cylindrical roll that is revolved about a curved axis of rotation. Unfortunately, a spreader roller cannot be placed in between the printing units, as the passage of an even partially inked web over a portion of a curved roller would cause the image to smear. Similarly, it is impractical to utilize a bustle wheel downstream of a printing station, as this too would smear the ink on the web if not limited to use in a circumferentially non-print area. Spreader rollers are thus similar to bustle wheels in that each is limited to addressing its own particular problem upstream from the printing unit.

Furthermore, neither of these approaches squarely addresses what occurs at the printing station itself, where many wrinkles actually form. They either anticipate the formation of a distortion and attempt to provided a fan out counter measure (e.g., the bustle wheel), or they attempt to resolve the problem of wrinkling after it has occurred but before the web arrives at the printing stations (the spreader roller).

Wrinkles may form at the nip of the blanket cylinder where the web moves past the blanket cylinder as the result of an irregular velocity profile across the nip of the blanket cylinder. Due to the geometric distortion that arises when a web passes over a cylinder and a blanket that are each somewhat deformable, the effective velocity with which the web is propelled past the nip of the blanket cylinder varies along the linear extent of the nip itself. For example, the effect of cylinder bending and/or blanket stiffness and/or compressibility may cause the web passing through the nip to have a varying velocity profile in which the center of the web moves faster than the periphery of the web, which gives rise to wrinkling. This is an example of a problem arising at a printing station that would best be solved at the printing station and that which would not smear the image.

There remains a need for a mechanism for smoothening out wrinkles at the blanket cylinder within the printing station that can be used in each printing station, thereby assuring proper registration of images from printing station to printing station.

SUMMARY OF THE INVENTION

The present invention solves this problem by providing the blanket cylinder with a blanket having a varying profile. The term "profile," as it is used in this patent specification, encompasses variations in a blanket variable with axial position. In particular, it encompasses variations with axial position of such a material properties of the blanket as compressibility, stiffness, and material thickness.

With respect to wrinkling that is due to speed variations of the web along the nip, a concave thickness profile is effective in countering the formation of wrinkles. With respect to a blanket cylinder having a flat linear profile, the concave profile will tend to increase the velocity with which the peripheral portion of a web is moved, because the peripheral portion of the concave profile has a greater effective radius (and hence defines a longer arc for a given angular velocity) than the center of the concave profile, which has a shorter radius. The aggregate effect of the use of a concave profile and the presence of other factors that tend to contribute an opposed effect (e.g., cylinder bending, blanket compressibility, blanket stiffness) is that the two counteract each other so as to provide a velocity profile across the nip (which, in this specific example is a constant velocity profile) that counters the formation of wrinkles.

Alternatively, where other factors combine to produce a particular wrinkling pattern within the web, a blanket of appropriate profile can be developed to provide a velocity profile capable of preventing the formation of the wrinkles, or undoing the wrinkling that has already occurred. One would merely have to apply basic principles of mechanics to determine the velocity profile necessary to provide the corrective effect onthe web. Furthermore, by overcompensating for a variable velocity profile, so that the lateral extremities of the web travel faster than the central web portions, one can generate lateral loads on the web that tug the web laterally as spreader rollers are intended to do. Such a particular embodiment is superior to spreader roller technology in that it can be employed within the printing station itself, where spreader rollers can not be employed for the reasons discussed above.

BRIEF DESCRIPTION OF THE FIGURES

For a more complete understanding of the invention, reference should now be made to the embodiments illustrated in greater detail in the accompanying drawings and described below. In the drawings.

DETAILED DESCRIPTION

Figure 1:
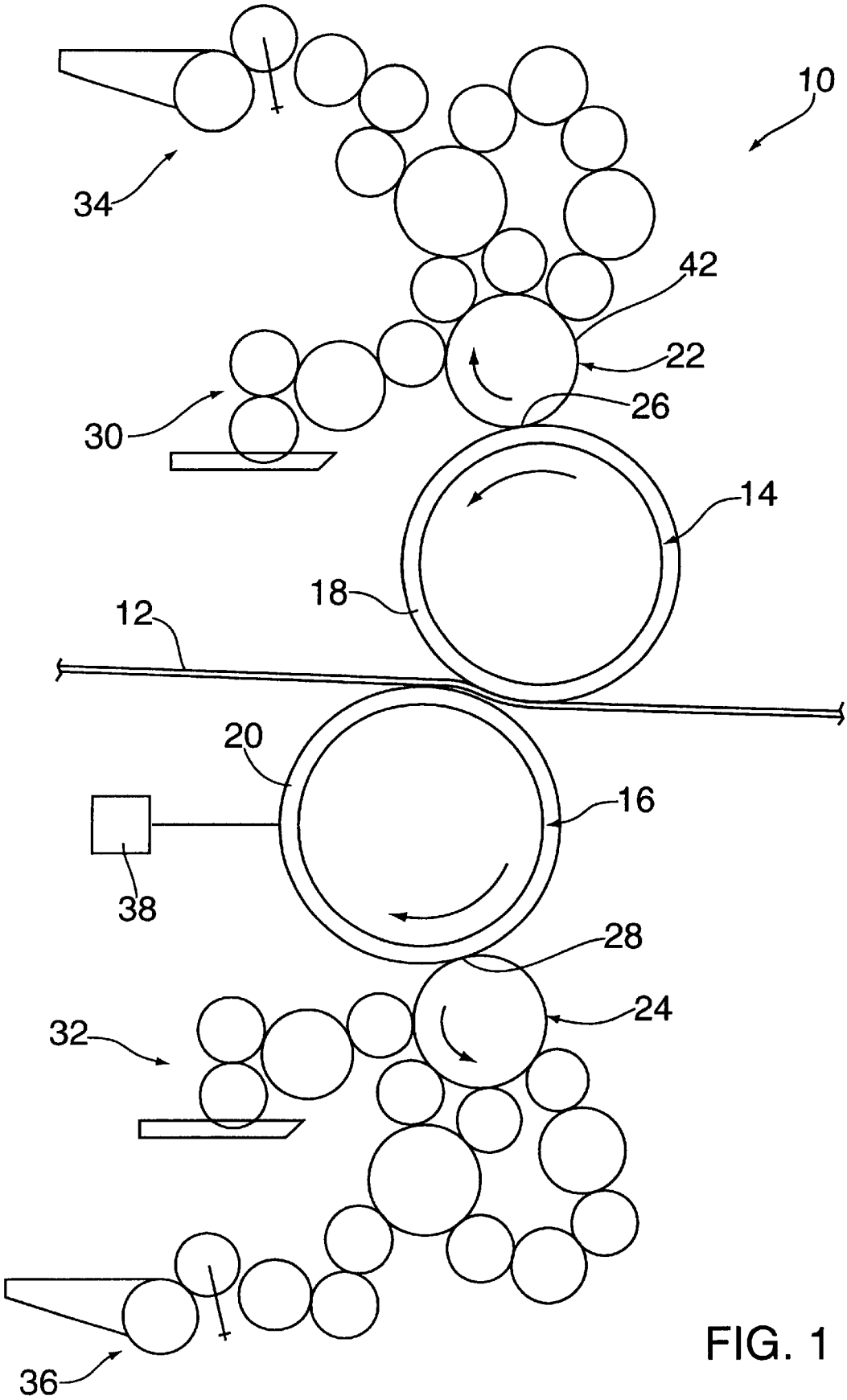
FIG. 1 is a schematic illustration of an offset printing press.

The present invention may be embodied in a number of different constructions and applied to a number of different offset printing presses. By way of example, the drawings illustrate the present invention as applied to an offset lithographic perfecting printing press 10.

The lithographic printing press 10 prints on opposite sides of a sheet material web 12. The lithographic printing press 10 includes identical upper and lower blanket cylinders 14 and 16. Blankets 18 and 20 are mounted on the blanket cylinders 14 and 16 and apply ink patterns to opposite sides of the web 12. Upper and lower plate cylinders 22 and 24 support printing plates which are disposed in rolling engagement with the blankets 18 and 20 at nips 26 and 28. Ink patterns are applied to the blankets 18 and 20 by the printing plates on the plate cylinders 22 and 24 at the nips 26 and 28. These ink patterns are, in turn, applied to opposite sides of the web 12 by the blankets 18 and 20.

The printing press 10 includes upper and lower dampener assemblies 30 and 32 which apply dampening solution to the printing plates on the plate cylinders 22 and 24. In addition, upper and lower inker assemblies 34 and 36 apply ink to the printing plates on the plate cylinders 22 and 24. A drive assembly, indicated schematically at 38 in FIG. 1, is operable to rotate the blanket cylinder 14 and 16 and plate cylinders 22 and 24 at the same surface speed. The drive assembly 38 also supplies power to drive the dampener assemblies 30 and 32 and inker assemblies 34 and 36. It is contemplated that the printing press 10 could have a construction other than the illustrated construction. For example, the printing press 10 could be constructed to print on only one side of the web 12.

The blanket itself is preferably made of elastomers, namely nitrile, and can include fabric reinforcement. A detailed discussion of the construction and composition of a blanket is set forth in U.S. application Ser. No. 07/699,668, as well as U.S. Pat. No. 3,700,541 to Shrimpton, U.S. Pat. No. 4,303,721 to Rodriguez, and U.S. Pat. No. 4,042,743 to Larson, the contents of each of which are incorporated herein in their entirety.

Figure 5:
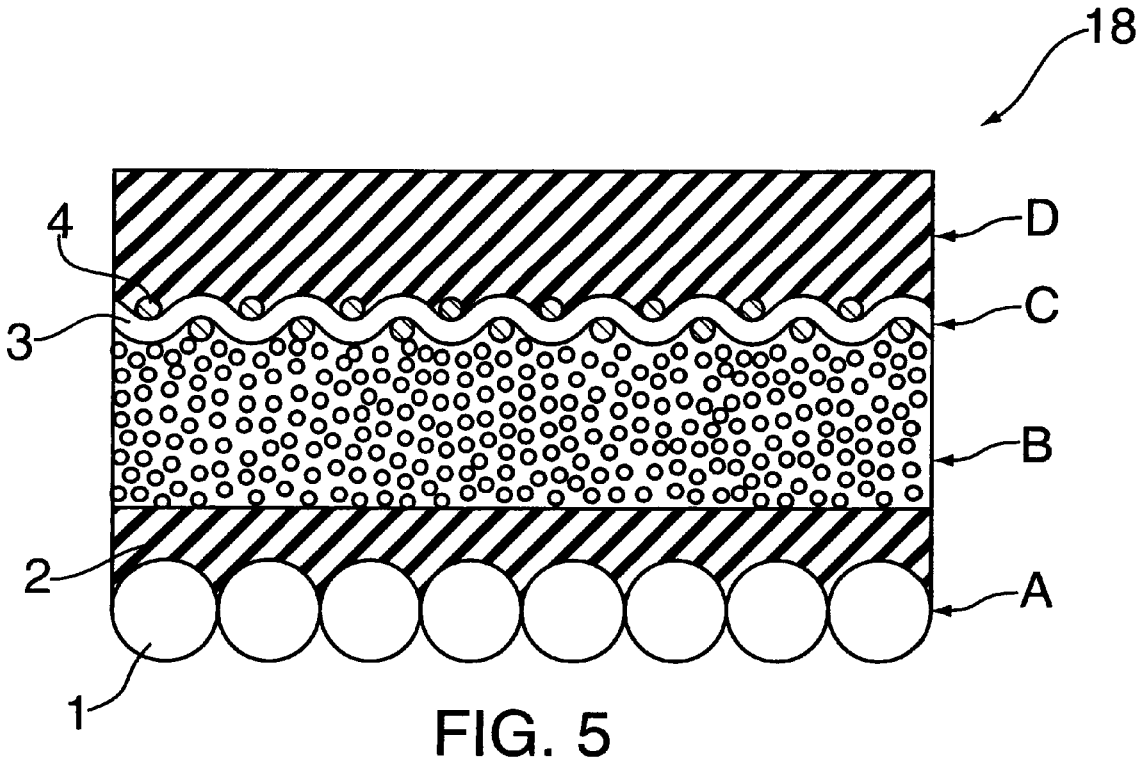
FIG. 5 is an enlarged fragmentary sectional view of a portion of a blanket that can be used as part of the invention.

Briefly, and with reference to FIG. 5, the blanket 18 is seen to be a composite of layers A, B, C, and D. Layer A is a strengthening layer consisting of a layer of flexible textile filamentary members 1, e.g., rayon cords, partially embedded in the surface of a flexible polymer composition 2, e.g. a blend of nitrile rubber and polypropylene or nylon.

Layer B is a compressible layer that consists of a microcellular resilient polymer, e.g., a microcellular nitrile rubber, containing uniformly distributed microcells produced by the incorporation of hollow microspheres.

Layer C is a textile fabric layer 3, and consists of a material having about 40 warp ends per cm, impregnated with a polymer composition 4 which may be the same as that of the printing surface, e.g., a nitrile rubber composition.

Layer D is a printing surface in the form of a veneer of a solvent-resistant elastomer, e.g., a nitrile rubber composition.

The above description of the composition of a blanket is illustrative only, and should not be viewed as limitative of the blanket compositions which can be employed with this invention. For example, the blanket constructions set forth in any of the aforecited references could be effectively employed in the instant invention.

Figure 2:
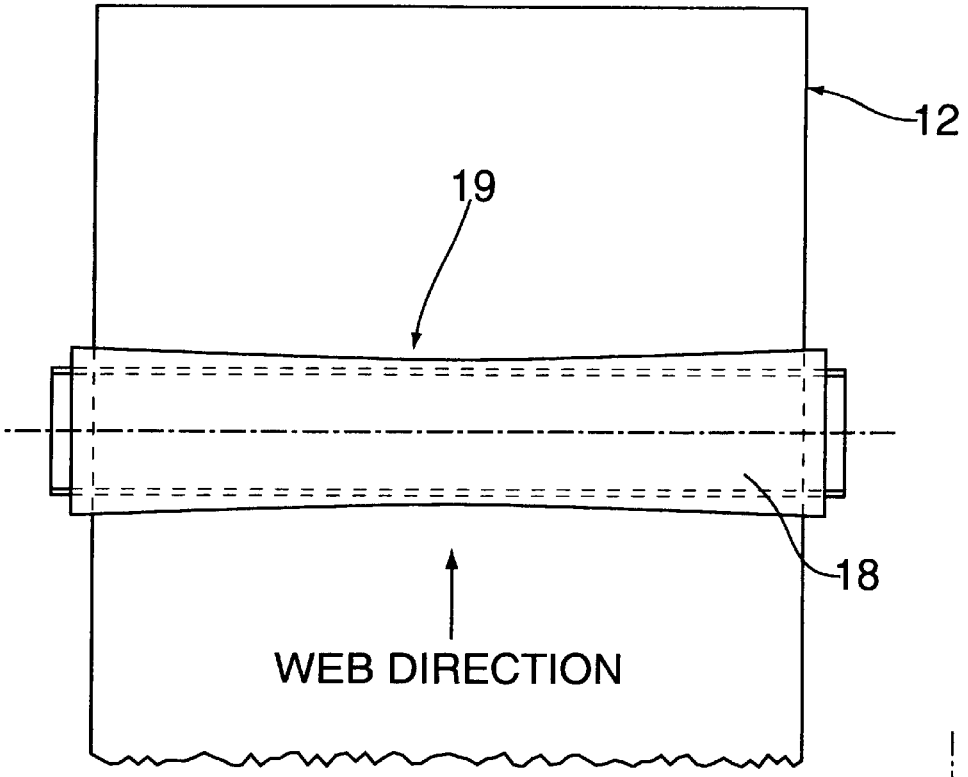
FIG. 2 is a plan view of a blanket and its blanket cylinder with the hidden profile of the cylinder shown in phantom, showing the concave profile characteristic of one possible embodiment of the blanket.
Figure 4:
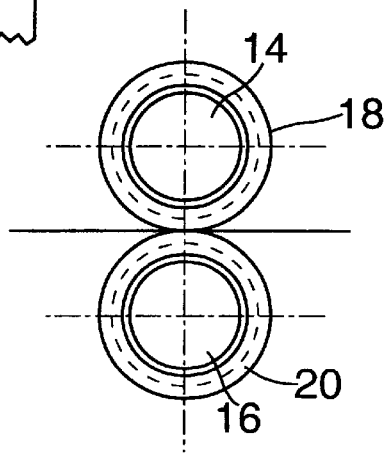
FIG. 4 is a side sectional view of a pair of cooperating blanket cylinders acting on both sides of a web.
Figure 3:
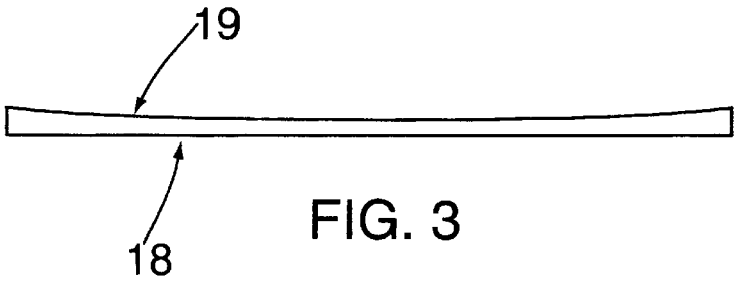
FIG. 3 shows a more focussed view of the profile of the blanket on the blanket cylinder illustrated in FIG. 2.

One manner of varying the profile of the blanket is to vary its thickness. For example, as seen in FIGS. 2 and 3, the blanket 18 can be formed so as to have a curved, concave profile 19. Because of the concavity of the profile, the lateral extremities of the surface of the blanket are radially further removed from the axis of rotation of the underlying blanket cylinder 14 than points on the center of the blanket 18. This in turn creates a velocity profile in which the lateral extremities of a web passing through a nip defined at the blankets travels faster with respect to the center of the web than it would were a conventional blanket having a cylindrical profile to be employed.

The concave profile can be obtained by mounting a cylindrical blanket onto a convex mandrel, and grinding the outer surface of the blanket until it assumes a flat, cylindrical profile of constant diameter whilst mounted on the convex mandrel. It is to be understood as lying within the scope of this invention that this or a similar grinding step can be performed on any of the multiple layers which can make up the composite blanket. Other shapes can be provided by using mandrels of other shapes (for example, a convex blanket profile could be made by grinding the blanket flat while it is mounted to a concave mandrel), or by removing varying levels of material from the blanket.

By judiciously choosing the blanket profile geometry, one obtains a blanket 18 that in use provides a uniform surface speed across the nip through which the web passes, thereby precluding the formation of any wrinkles due to a varying velocity profile. Alternatively, one may provide a velocity profile that generates lateral loads on the web so as to compensate for other distortion-creating effects, whether they have occurred prior to the printing station, at the printing station, or in anticipation of their creation at a point downstream of the printing station.

Figure 6:
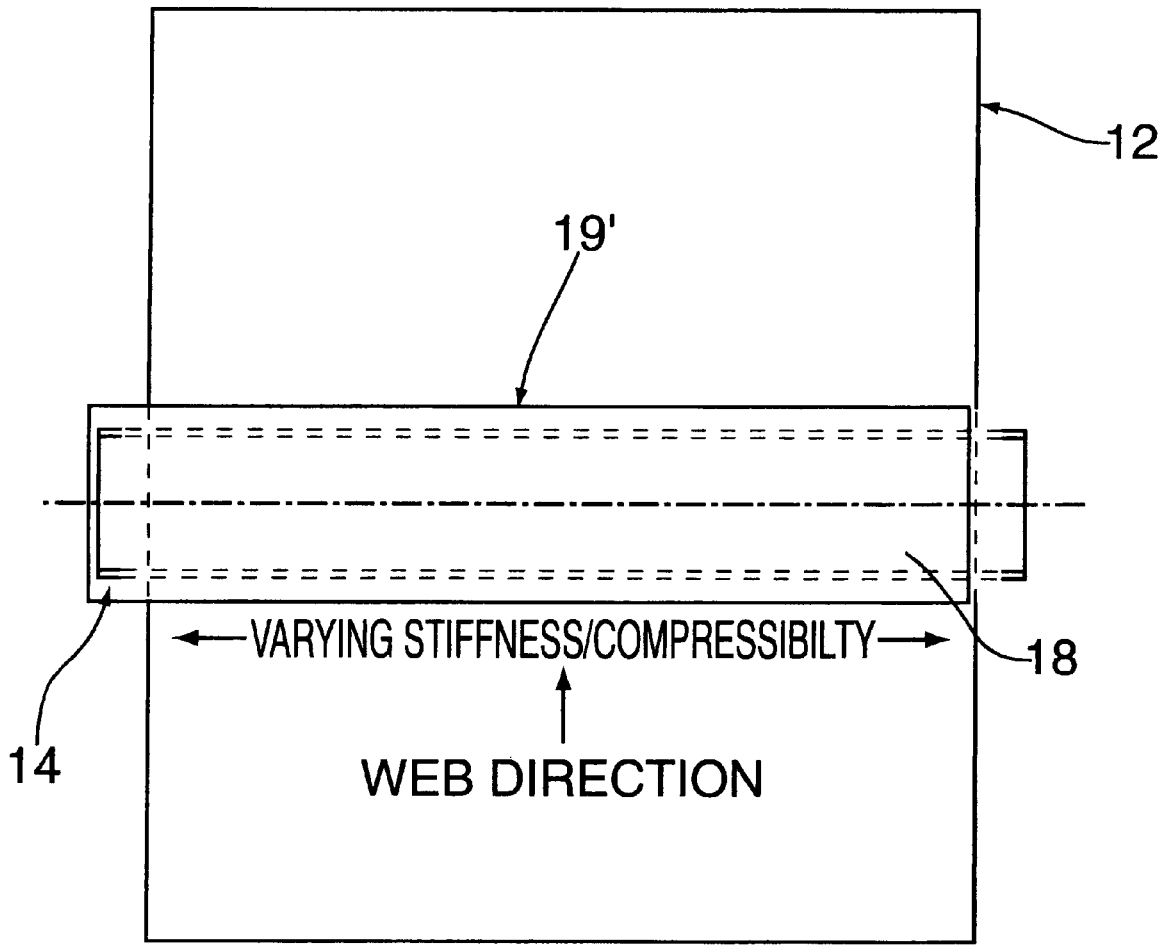
FIG. 6 is a plan view of a constant thickness blanket that varies in a material property as a function of axial position.

FIG. 6 illustrates a blanket whose profile does 19' not vary in thickness, but rather varies in its stiffness, compressibility, or coefficient of friction. For example, by using a profile that is stiffer at the ends of the blanket than at the center, one can obtain a corrective velocity profile across the nip that functions similar to the concavely varying thickness profile.

In general terms, the velocity along the roll is a function of the effective radius, which varies due to the bending of the cylinder roll as well as the compressibility or stiffness of the surface of the roll. Therefore, the compressibility or stiffness can be varied so as to vary the effective radius of the cylinder roll.

Figure 7:
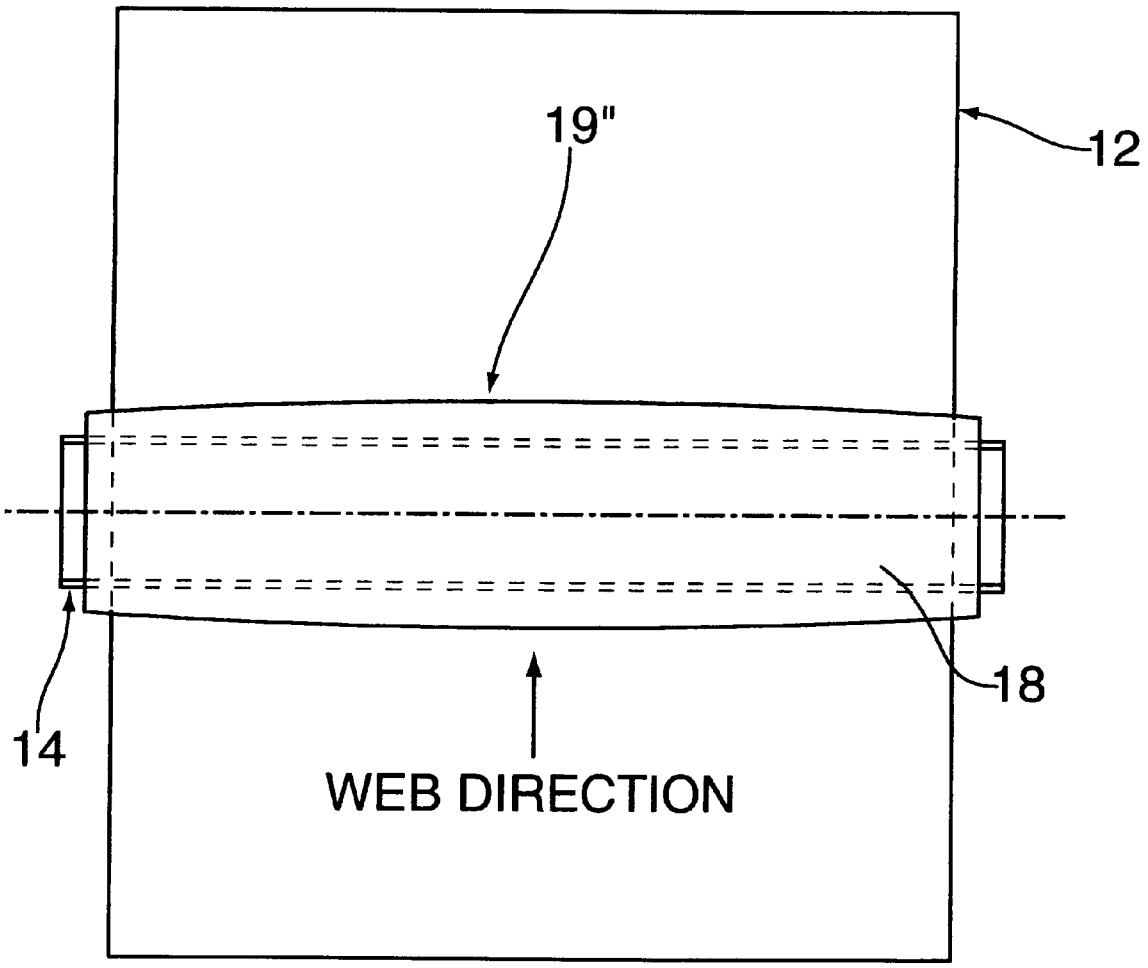
FIG. 7 is a view similar to FIG. 2, illustrating an embodiment in which the blanket has a convex profile.
Figure 8:
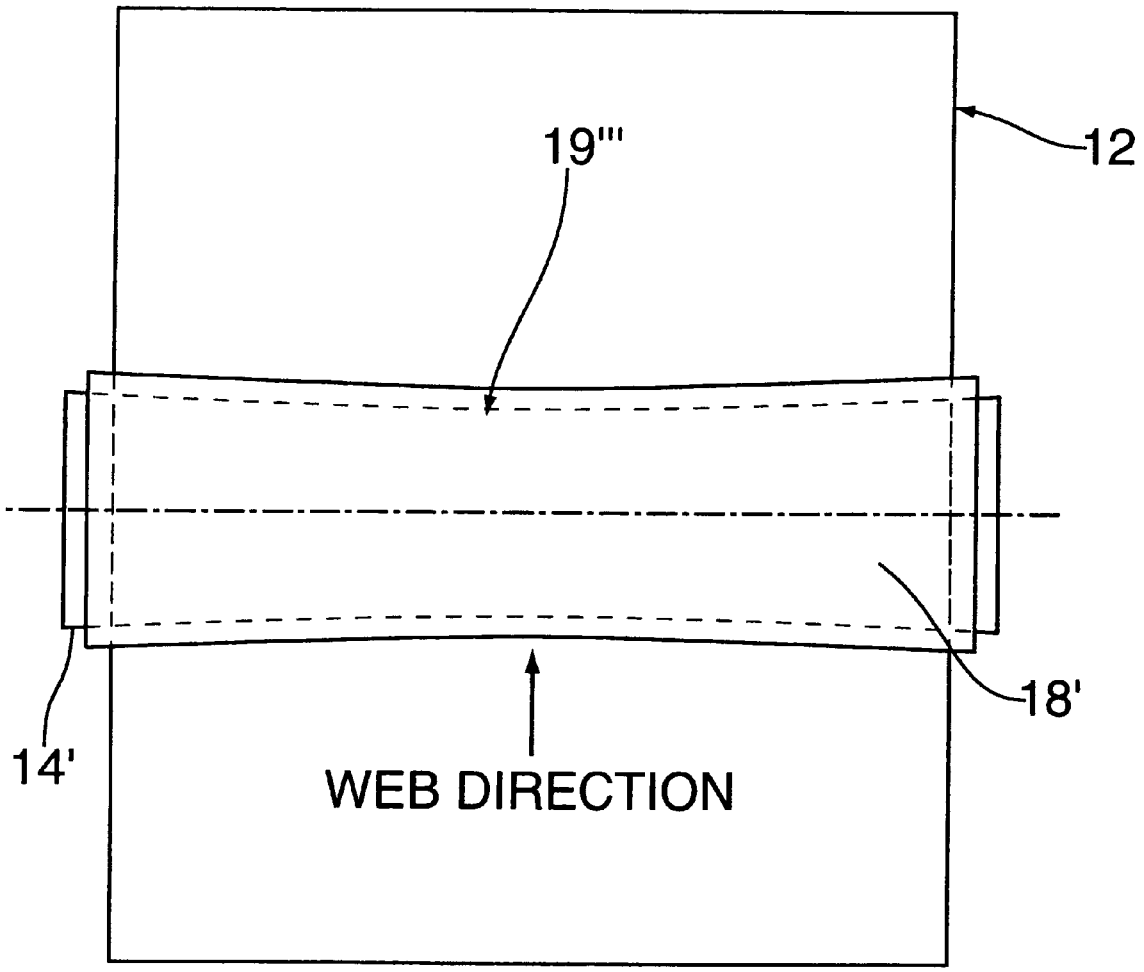
FIG. 8 is a view similar to FIG. 2, illustrating an embodiment in which the blanket itself is flat, but is mounted to a blanket cylinder having a varying profile (here, concave).

FIGS. 7 and 8 demonstrate the further scope of this invention in their illustration of further embodiments. In FIG. 7, the blanket has a convex profile 19". As discussed above, depending on the effect desired, this and other shapes could be employed as well.

FIG. 8 illustrates that rather than alter the profile of the blanket, one can instead modify the profile of the underlying blanket cylinder 18'. In this embodiment, a concave blanket cylinder is used with a flat blanket (in contrast to FIG. 2, which shows a constant diameter blanket cylinder and a concave in profile blanket).

What is claimed is:

1. A printing blanket for mounting on a blanket cylinder of a printing unit of an offset lithographic printing press, said blanket being composed of an elastically deformable material and having an axially varying radial profile that varies axially as a function of a material property of the printing blanket, wherein the material property gradually varies from a center of the cylinder towards ends of the of cylinder, wherein the axially varying radial profile produces a substantially uniform velocity profile across a web traveling through the printing unit of the offset lithographic printing press thereby maintaining a printing width of the web.

2. The blanket of claim 1, wherein the material property is blanket stiffness.

3. The blanket of claim 1, wherein the material property is the blanket compressibility.

4. The blanket of claim 1, wherein the elastically deformable material includes a composite material.

5. The blanket of claim 1 wherein the elastically deformable material includes an elastomer.

6. The blanket of claim 1, wherein the blanket has a seamless, cylindrical construction.

7. The blanket of claim 1 wherein the blanket is flat.

8. A printing unit of a printing press, comprising:

a rotatable blanket cylinder having an axis of rotation;

a printing blanket mounted on said blanket cylinder for applying an ink pattern to a web of material;

a rotatable plate cylinder for carrying an image to be printed and to apply the ink pattern to said printing blanket, the printing plate and printing blanket being disposed in rolling engagement at a nip formed therebetween;

a drive for rotating said plate and blanket cylinders; and an inker for applying ink to said plate cylinder, wherein said printing blanket is disposed in rolling engagement with the plate cylinder at said nip, said printing blanket having an inner surface configured to mate with an outer surface of the blanket cylinder and an axially varying radial profile that varies axially as a function of a material property of the printing blanket, wherein the material property gradually varies from a center of the cylinder towards ends of the of cylinder, the axially varying radial profile producing a substantially uniform velocity profile across the web of material as the web travels through the printing unit of the printing press thereby maintaining a printing width of the web.

9. The blanket of claim 8, wherein the material property is the blanket stiffness.

10. The blanket of claim 8, wherein the material property is the blanket compressibility.

* * * * *